US008322289B2

(12) United States Patent
Okubo et al.

(10) Patent No.: US 8,322,289 B2
(45) Date of Patent: Dec. 4, 2012

(54) LOW FLOOR VEHICLE

(75) Inventors: Yoshiki Okubo, Mihara (JP); Hiroyuki Kono, Hiroshima (JP); Kousuke Katahira, Kawasaki (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 13/133,747

(22) PCT Filed: Jun. 11, 2009

(86) PCT No.: PCT/JP2009/060657

§ 371 (c)(1),
(2), (4) Date: Jun. 9, 2011

(87) PCT Pub. No.: WO2010/095284

PCT Pub. Date: Aug. 26, 2010

(65) Prior Publication Data

US 2011/0239899 A1 Oct. 6, 2011

(30) Foreign Application Priority Data

Feb. 20, 2009 (JP) ..... 2009-037992

(51) Int. Cl.
*B61F 3/00* (2006.01)

(52) U.S. Cl. ..... 105/185; 105/182.1; 105/158.2; 105/215.2; 105/72.2

(58) Field of Classification Search ..... 105/158.2, 105/182.1, 185, 215.1, 215.2, 72.2
See application file for complete search history.

(56) References Cited

U.S. PATENT DOCUMENTS 3,333,551 A * 8/1967 Pelz et al. ..... 105/183

(Continued)

FOREIGN PATENT DOCUMENTS

EP 0183619 A1 6/1986

(Continued)

OTHER PUBLICATIONS

JP Office Action for 2009-037992 dated Aug. 30, 2011 (Translation Only).

International Search Report for PCT/JP2009/060657 mailed Aug. 25, 2009.

(Continued)

*Primary Examiner* — Jason C Smith

(74) *Attorney, Agent, or Firm* — Lowe Hauptman Ham & Berner LLP

(57) ABSTRACT

A low floor vehicle reduces, when the vehicle enters a curved track, the lateral force of the vehicle, prevents occurrence of vibration and creaking sounds of the vehicle, improves riding quality of passengers, and reduces wear of wheel flanges. A low floor vehicle includes a bogie frame 9 of a bogie 7, a pair of bogie frame cross beams 9*a* arranged along a vehicle lateral direction in the middle of a vehicle longitudinal direction of the bogie frame 9 and arranged spaced apart from each other in the vehicle longitudinal direction, and a pair of wheels 8 provided in each of a vehicle front edge direction and a vehicle rear edge direction with respect to the pair of bogie frame cross beams 9*a* of the bogie frame 9 and configured to travel on a track 1. A pair of flexible traction rods 15 arranged along the vehicle longitudinal direction and configured to be capable of extending and retracting in the vehicle longitudinal direction are provided in the bogie 7, the pair of flexible traction rods 15 are arranged spaced apart from each other in a vehicle lateral direction, one ends 15*b* of the flexible traction rods 15 are attached to the bogie frame cross beams 9*a*, and the other ends 15*c* of the flexible traction rods 15 are attached to a receiving section 6*c* of in the vehicle body 6, and the bogie 7 is configured to be capable of turning with respect to the vehicle body 6.

2 Claims, 8 Drawing Sheets

U.S. PATENT DOCUMENTS

| | | | | | |
|---|---|---|---|---|---|
| 3,665,865 | A | * | 5/1972 | Pelz | 105/183 |
| 5,086,706 | A | * | 2/1992 | Boivin | 105/168 |
| 5,107,773 | A | * | 4/1992 | Daley et al. | 105/185 |
| 5,211,116 | A | * | 5/1993 | Schneider | 105/168 |
| 5,372,073 | A | * | 12/1994 | Cattani | 105/3 |
| 5,448,953 | A | * | 9/1995 | Bieker et al. | 105/158.2 |
| 6,289,821 | B1 | | 9/2001 | Amrath | |
| 6,601,520 | B2 | * | 8/2003 | Eche et al. | 105/34.1 |
| 2001/0051746 | A1 | * | 12/2001 | Hagihara et al. | 562/400 |
| 2002/0195018 | A1 | * | 12/2002 | Eche et al. | 105/158.2 |
| 2010/0294164 | A1 | * | 11/2010 | Oku et al. | 105/182.1 |
| 2011/0239899 | A1 | * | 10/2011 | Okubo et al. | 105/185 |
| 2012/0060719 | A1 | * | 3/2012 | Nishimura et al. | 105/182.1 |

FOREIGN PATENT DOCUMENTS

| | | | | |
|---|---|---|---|---|
| JP | 3-501008 | A | | 3/1991 |
| JP | 11-278260 | A | | 10/1999 |
| JP | 11342844 | A1 | | 12/1999 |
| JP | 2003-063394 | A | | 3/2003 |
| JP | 3606806 | B2 | | 1/2005 |
| JP | 2006-160087 | A | | 6/2006 |
| JP | 2008-132828 | A | | 6/2008 |
| JP | 2008132828 | A | * | 6/2008 |
| JP | 2008-162455 | A | | 7/2008 |

OTHER PUBLICATIONS

Notice of Allowance for JP2009-037992 mailed May 11, 2012.

* cited by examiner

LOW FLOOR VEHICLE

RELATED APPLICATIONS

The present application is a National Phase of International Application Number PCT/JP2009/060657, filed Jun. 11, 2009 and claims priority from, Japanese Application Number 2009-037992, filed Feb. 20, 2009.

TECHNICAL FIELD

The present invention relates to a low floor vehicle that travels on a track.

BACKGROUND ART

In recent years, streetcars and the like have adopted low floor vehicle designs in which a floor surface in the vehicle is set close to a road surface to reduce the difference in level for stepping up and down for passengers so as to make the vehicles barrier-free. In such a streetcar, because of limitations such as road traffic conditions, a large number of curved tracks curving with a curvature radius equal to or less than 20 m are provided. A low floor vehicle having a low center of gravity because of the structure thereof can travel relatively stably on such curved tracks. However, there is a problem in that, when the vehicle enters a curved track, an angle in a traveling direction of wheels with respect to a tangential direction of the curved track (hereinafter referred to as "attack angle") increases. When this attack angle is large, in wheels present on an outside rail during travel on the curved track, in some cases, flanges of the wheels come into contact with the track. At this point, pressure is applied from the wheel flanges to the vehicle, the lateral pressure of the vehicle increases, and vibration and creaking sounds occur in the vehicle. As a result, there is a problem in that riding comfort for passengers is degraded and the wheel flanges wear out.

Taking such a problem into account, a low floor vehicle called an LRV (Light Rail Vehicle) as disclosed in Patent Document 1 has been developed. In FIG. 7, an example of the configuration of this LRV is shown. A traveling direction of this LRV is indicated by an arrow A. In the explanation, it is assumed that the traveling direction is to the vehicle front. Referring to FIG. 7, the LRV includes two front vehicles 102 and one intermediate vehicle 103 traveling on a track 101. As a vehicle composition, the one intermediate vehicle 103 is arranged between the two front vehicles 102.

Pin connectors 105 are arranged along an axis extending in a vehicle vertical direction in connecting sections 104 between the front vehicles 102 and the intermediate vehicle 103. The front vehicles 102 are coupled to the intermediate vehicle 103 to be capable of turning around the pin connectors 105. Therefore, the front vehicles 102 and the intermediate vehicle 103 can curve around the pin connectors 105 to correspond to a curvature radius R of the curved track 101. Furthermore, in the connecting sections 104, dampers, springs, or the like (not shown) are provided to suppress the turning of the front vehicles 102 and secure safety during high-speed travel of the vehicle.

Bogies 107 are arranged under vehicle bodies 106 of the front vehicles 102. As shown in FIGS. 8 to 10, a pair of wheels 108 is provided at each of a vehicle front direction and a vehicle rear direction of the bogie 107. The pair of wheels 108 are configured to be pivotable independently of each other around the same axis 108*a* extending in a vehicle lateral direction and coupled by a journal member 109. The journal member 109 is arranged at each of a vehicle front direction and a vehicle rear direction of each of bogie frames 110 formed as frame members of the bogie 107. Conical rubber 111 is provided as a shaft spring for the wheel 108 between the journal member 109 and the bogie frame 110. Vibration transmitted from the wheel 108 to the bogie frame 110 is suppressed by this conical rubber 111. Furthermore, the journal member 109 extends at a position close to the road surface between the pair of wheels 108. A floor surface (not shown) in the vehicle is arranged at the journal member 109. Therefore, the floor surface in the vehicle is configured to be close to the road surface.

Referring to FIG. 7 again, when the vehicle traveling in the traveling direction enters the curved track 101, force directed in a straight forward direction by inertia acts on the vehicle bodies 106. Force directed in a curving direction along the curved track 101 acts on the bogies 107. Therefore, force acting on the entire front vehicles 102 is unbalanced. At this point, the straight forward force by inertia also affects the bogies 107. The bogies 107 are less easily curved along the curved track 101. As a result, an attack angle $\alpha$, which is an angle in the traveling direction (indicated by an arrow C) of the wheel 108 with respect to the tangential direction (indicated by an arrow B) of the curved track, increases. It is likely that wheel flanges 108*b* (shown in FIGS. 8 to 10) of the wheels 108 on an outside rail side come into contact with the track. At the time of this contact, pressure is applied from the wheel flanges 108*b* to the vehicle, lateral pressure of the vehicle increases, and vibration and creaking sounds occur in the vehicle. As a result, there is a problem in that riding comfort of passengers is degraded and the wheel flanges 108*b* wear out.

To absorb such unbalance of force, the bogies 107 are configured to be movable in the vehicle lateral direction with respect to the vehicle bodies 106. Specifically, as shown in FIGS. 8 to 10, traction rods 112 that transmit traction force of the bogie 107 to the vehicle body 106 are arranged along a vehicle longitudinal direction. Ends 112*a* on the vehicle rear direction of the traction rods 112 are attached to the bogie 107 side via a spherical bush or a rubber vibration insulator (not shown). Ends 112*b* on the vehicle front direction of the traction rods 112 are attached to the vehicle body 106 side via a spherical bush or a rubber vibration insulator (not shown).

CITATION LIST

Patent Literature

Patent Literature 1: Japanese Patent Laid-Open No. 2008-132828

SUMMARY OF INVENTION

Technical Problem

However, in the vehicle of Patent Document 1, as shown in FIG. 7, the front vehicles 102 and the intermediate vehicle 103 are about to curve around the pin connectors 105 to correspond to the curvature radius R of the curved track 101 during the traveling of the vehicle on the curved track. However, in some cases, the front vehicles 102 do not sufficiently curve with respect to the intermediate vehicle 103 because of the influence of the dampers of the connecting sections 104. In some cases, the wheels 108 do not curve along the curved track while being affected by cant, slack, or the like of the curved track. In this case, it is likely that the traveling direction (indicated by the arrow B) of the wheels 108 does not face the tangential direction (indicated by the arrow C) of the curved track 101 and the attack angle α increases. Therefore, the pressure still applies from the wheel flanges 108*b* to the vehicle, the lateral pressure of the vehicle increases, and vibration and creaking sounds occur in the vehicle. As a result, there is a problem in that riding comfort of passengers is degraded and the wheel flanges 108*b* wear out.

Another problem is that since a difference between forces acting on the vehicle bodies 106 and the bogies 107 is absorbed when the vehicle enters the curved track, it is likely that, even if the bogies 107 move in the vehicle lateral direction with respect to the vehicle bodies 106, the straight forward force by inertia is large and imbalance of the three cannot be completely absorbed, in this case, the bogies 107 are still affected by the straight forward force by inertia. In some cases, the attack angle α increases. Therefore, the pressure is still applied from the wheel flanges 108*b* to the vehicle, the lateral pressure of the vehicle increases, and vibration and creaking sounds occur in the vehicle. As a result, there is a problem in that riding comfort of passengers is degraded and the wheel flanges 108*h* wear out.

The present invention has been devised in view of such circumstances, and it is an object of the present invention to provide a low floor vehicle that can reduce, when the vehicle enters a curved track, the lateral pressure of the vehicle, prevent occurrence of vibration and creaking sounds of the vehicle, improve riding comfort of passengers, and reduce wear of wheel flanges.

Solution to Problem

In order to solve the problems, a low floor vehicle of the present invention is a low floor vehicle including: a bogie provided under a vehicle body; a bogie frame configured as a frame member of the bogie; a pair of bogie frame cross beams arranged along a vehicle lateral direction in the middle of a vehicle longitudinal direction of the bogie frame and arranged spaced apart from each other in the vehicle longitudinal direction; and a pair of wheels provided in each of a vehicle front direction and a vehicle rear direction by the pair of bogie frame cross beams of the bogie frame and configured to travel on a track, wherein a pair of flexible traction rods arranged along the vehicle longitudinal direction and configured to be capable of extending and retracting in the vehicle longitudinal direction are provided in the bogie, the pair of flexible traction rods are arranged spaced apart from each other in a vehicle lateral direction, ends of the flexible traction rods are attached to the bogie frame cross beams, and the other ends of the flexible traction rods are attached to a receiving section provided in the vehicle body, and the bogie is configured to be capable of turning with respect to the vehicle body.

Furthermore, in order to solve the problems, a low floor vehicle of the present invention is a low floor vehicle including: a bogie provided under a vehicle body; a bogie frame configured as a frame member of the bogie; a pair of bogie frame cross beams arranged along a vehicle lateral direction in the middle of a vehicle longitudinal direction of the bogie frame and arranged spaced apart from each other in the vehicle longitudinal direction; and a pair of wheels provided in each of a vehicle front direction and a vehicle rear direction with respect to the pair of bogie frame cross beams of the bogie frame and configured to travel on a track, wherein one traction rod arranged along the vehicle longitudinal direction in the center in a vehicle lateral direction is provided in the bogie, one end of the traction rod is attached to the bogie frame cross beam, and the other end of the traction rod is attached to a receiving section provided in the vehicle body, a restoring rod arranged along the vehicle longitudinal direction and configured to be capable of extending and retracting in the vehicle longitudinal direction is provided at least one of left and right outer sides in the vehicle lateral direction of the traction rod, one end of the restoring rod is attached to the bogie frame cross beam, and the other end of the restoring rod is attached to the receiving section provided in the vehicle body, and the bogie is configured to be capable of turning with respect to the vehicle body.

In the low floor vehicle of the present invention, a turn suppression damper arranged along the vehicle lateral direction and configured to be capable of attenuating force in the vehicle lateral direction is provided in each of a front direction section of the bogie frame cross beam on the vehicle front direction and a rear direction section of the bogie frame cross beam on the vehicle rear direction, one end of the turn suppression damper is attached to the bogie frame cross beam, the other end of the turn suppression damper is attached to the receiving section provided in the vehicle body, and a stopper provided in the vehicle body and a stopper member provided in the bogie are arranged to be capable of coming into contact with each other to regulate a turn of the vehicle body.

Advantageous Effects of Invention

According to the present invention, effects explained below can be obtained. A low floor vehicle of the present invention is a low floor vehicle including: a bogie provided under a vehicle body; a bogie frame configured as a frame member of the bogie; a pair of bogie frame cross beams arranged along a vehicle lateral direction in the middle of a vehicle longitudinal direction of the bogie frame and arranged spaced apart from each other in the vehicle longitudinal direction; and a pair of wheels provided in each of a vehicle front direction and a vehicle rear direction with respect to the pair of bogie frame cross beams of the bogie frame and configured to travel on a track, wherein a pair of flexible traction rods arranged along the vehicle longitudinal direction and configured to be capable of extending and retracting in the vehicle longitudinal direction are provided in the bogie, the pair of flexible traction rods are arranged spaced apart from each other in a vehicle lateral direction, ends of the flexible traction rods are attached to the bogie frame cross beams, the other ends of the flexible traction rods are attached to a receiving section provided in the vehicle body, and the bogie is configured to be capable of turning with respect to the vehicle body.

Therefore, when the vehicle enters a curved track, if a wheel on an outside rail side of the pair of wheels comes into contact with the track and force directed to the inner side in the vehicle lateral direction is applied to the wheel on the outside rail side, force for turning with respect to the vehicle body acts on the bogie. At this point, one of the pair of flexible traction rods extends and the other of the pair of flexible traction rods retracts, whereby the bogie can turn with respect to the vehicle body. Force directed in a straight forward direction by the inertia of the vehicle body is absorbed by such a turn of the bogie and less easily affects the bogie. The bogie easily curves along the curved track. As a result, the wheel changes to a state more closely along the curved track and the vehicle can enter the curved track at a small attack angle. Therefore, when the vehicle enters the curved track, contact pressure between the wheel on the outside rail side and the track is relaxed, lateral pressure applied to the vehicle is reduced, and occurrence of vibration and creaking sound of the vehicle is prevented. Therefore, riding comfort of passengers is improved and wear of a wheel flange is reduced. In other words, the vehicle can smoothly pass the curved track.

A low floor vehicle of the present invention is a low floor vehicle including: a bogie provided under a vehicle body; a bogie frame configured as a frame member of the bogie; a pair of bogie frame cross beams arranged along a vehicle lateral direction in the middle of a vehicle longitudinal direction of the bogie frame and arranged spaced apart from each other in the vehicle longitudinal direction; and a pair of wheels provided in each of a vehicle front direction and a vehicle rear direction with respect to the pair of bogie frame cross beams of the bogie frame and configured to travel on a track, wherein one traction rod arranged along the vehicle longitudinal direction in the center in a vehicle lateral direction is provided in the bogie, one end of the traction rod is attached to the bogie frame cross beam, the other end of the traction rod is attached to a receiving section provided in the vehicle body, a restoring rod arranged along the vehicle longitudinal direction and configured to be capable of extending and retracting in the vehicle longitudinal direction is provided at least one of left and right outer sides in the vehicle lateral direction of the traction rod, one end of the restoring rod is attached to the bogie frame cross beam, the other end of the restoring rod is attached to the receiving section provided in the vehicle body, and the bogie is configured to be capable of turning with respect to the vehicle body.

Therefore, when the vehicle enters a curved track, if a wheel on an outside rail side of the pair of wheels comes into contact with the track and force directed to the inner side in the vehicle lateral direction is applied to the wheel on the outside rail side, force for turning with respect to the vehicle body acts on the bogie. At this point, one of the pair of restoring rods extends and the other of the pair of restoring rods retracts, whereby the bogie can turn around the traction rod with respect to the vehicle body. Force directed in a straight forward direction by the inertia of the vehicle body is absorbed by such a turn of the bogie and less easily affects the bogie. The bogie easily curves along the curved track. As a result, the wheel changes to a state further along the curved track and can enter the curved track at a small attack angle. Therefore, when the vehicle enters the curved track, contact pressure between the wheel on the outside rail side and the track is relaxed, lateral pressure applied to the vehicle is reduced, and occurrence of vibration and creaking sounds of the vehicle is prevented. Therefore, riding comfort of passengers is improved and wear of wheel flanges is reduced. In other words, the vehicle can smoothly pass the curved track.

In the low floor vehicle of the present invention, a turn suppression damper arranged along the vehicle lateral direction and configured to be capable of attenuating force in the vehicle lateral direction is provided in each of a front direction section of the bogie frame cross beam on the vehicle front direction and a rear direction section of the bogie frame cross beam on the vehicle rear direction, one end of the turn suppression damper is attached to the bogie frame cross beam, the other end of the turn suppression damper is attached to the receiving section provided in the vehicle body, and a stopper provided in the vehicle body and a stopper member provided in the bogie are arranged to be capable of coming into contact with each other to regulate a turn of the vehicle body. When external force from the vehicle lateral direction is applied to the vehicle other than the force acting on the bogie from the track when the vehicle enters the curved track as explained above, such external force is attenuated by the turn suppression damper provided on each of the vehicle front direction and the vehicle rear direction. It is possible to prevent the bogie from being turned with respect to the vehicle body by force other than the force acting on the bogie from the track. Therefore, during linear track traveling of the vehicle or the like, the bogie does not turn with respect to the vehicle body and traveling stability of the vehicle is secured. Since a movement amount in the vehicle lateral direction of the bogie is limited by the stopper member, a large turn of the bogie is prevented and traveling stability of the vehicle is further secured. Therefore, it is possible to more surely obtain the effects explained above while securing traveling stability of the vehicle.

BRIEF DESCRIPTION OF DRAWINGS

FIG. 4(*b*) is a longitudinal sectional view showing a schematic structure of a rubber-type flexible traction rod.

DESCRIPTION OF EMBODIMENTS

First Embodiment

Figure 1:
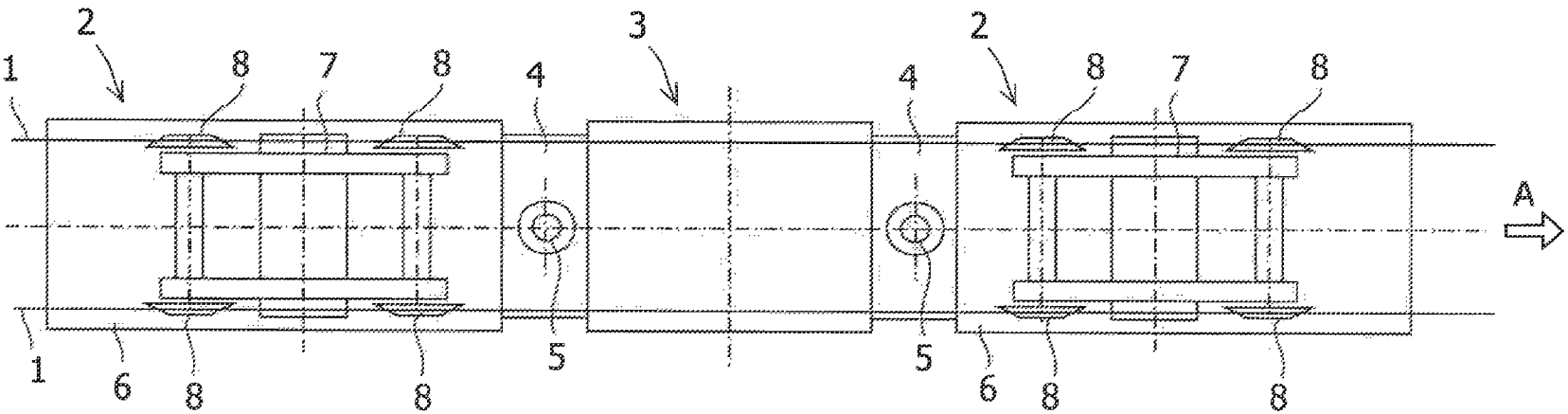
FIG. 1 is an explanatory diagram showing a low floor vehicle during linear track traveling in a first embodiment of the present invention.

A low floor vehicle (hereinafter referred to as "vehicle") in a first embodiment of the present invention is explained below, in the first embodiment, the vehicle is explained using an LRV as shown in FIG. 1 as an example of the vehicle. In the explanation, it is assumed that a traveling direction of the vehicle is a vehicle front. FIG. 1 is a diagram of the vehicle viewed from above. The traveling direction of the vehicle is indicated by the arrow A. The vehicle shown in FIG. 1 includes two front vehicles 2 and one intermediate vehicle 3 traveling on a track 1. As a vehicle composition, the one intermediate vehicle 3 is arranged between the two front vehicles 2. Connecting sections 4 are provided between the front vehicles 2 and the intermediate vehicle 3. Pin connectors 5 are provided in the connecting sections 4 along an axis extending in a vehicle vertical direction. The front vehicles 2 are coupled to the intermediate vehicle 3 to be capable of turning around the pin connectors 5. Bogies 7 are provided under vehicle bodies 6 of the front vehicles 2. Wheels 8 provided in the bogies 7 are configured to travel on the track 1.

The structure of the bogie 7 is explained with reference to the bogie 7 in a state during linear traveling shown in FIGS. 2 and 3. A traveling direction of the vehicle is indicated by the arrow A. In the bogie 7, a bogie frame 9 is provided as a frame member of the bogie 7. The vehicle body 6 (shown in FIG. 1) is supported by this bogie frame 9. Two bogie frame cross beams 9*a* extending in a vehicle lateral direction are disposed in this bogie frame 9 spaced apart from each other in a vehicle longitudinal direction. Furthermore, in the bogie frame 9, two bogie frame side beams 9*b* extending in the vehicle longitudinal direction respectively cross the two bogie frame cross beams 9*a* and are disposed spaced apart from each other in the vehicle lateral direction.

Journal members 10 respectively provided at the front end and the rear end of the bogie frame side beams 9*b*. Therefore, the bogie frame cross beams 9*a* are located closer to the center in the vehicle longitudinal direction than the journal members 10. A pair of wheels 8 are attached at both ends in the vehicle lateral direction of each of the journal members 10 to be pivotable independently from each other about the same axis 8*a*. Wheel flanges 8*b* are provided at edges on the inner side in the vehicle lateral direction of the wheels 8. The journal member 10 is configured to extend near the road surface between both ends to which the wheels 8 are attached. Conical rubbers 11 are disposed as shaft springs of the wheels 8 between the bogie frame side beams 9*b* and the ends of the journal member 10. The ends of the journal members 10 are attached to the bogie frame side beams 9*b* via the conical rubbers 11. The conical rubbers 11 are configured to absorb vibrations from the wheels 8 in the vehicle vertical direction.

Turn suppression dampers 12 are provided on the vehicle front direction and the vehicle rear direction of the bogie 7. The turn suppression dampers 12 are arranged along axes 12*a* extending in the vehicle lateral direction and tilt in the vehicle vertical direction. The turn suppression tampers 12 are configured to be capable of attenuating force applied from the vehicle lateral direction. The axes 12*a* of the turn suppression dampers 12 are apart from a middle point 13 of the bogie frame 9 in the vehicle longitudinal direction by a distance E. The middle point 13 of the bogie frame 9 is located at a crossing point of an axis 8*c* passing the center in the vehicle lateral direction of the pair of wheels 8 in a linear track traveling state and extending in the vehicle longitudinal direction and an axis 8*d* passing the center between the wheels 8 on the vehicle front direction and the vehicle rear direction in the linear track traveling state and extending along the vehicle lateral direction.

One end of the turn suppression damper 12 on the vehicle front direction is attached to the front direction section of the bogie frame cross beam 9*a* on the vehicle front direction via a spherical flange. The other end of the turn suppression damper 12 on the vehicle front direction is attached to a receiving section 6*a*, which is provided in the vehicle body 6, via a spherical flange. One end of the turn suppression damper 12 on the vehicle rear direction is attached to the rear direction section of the bogie frame cross beam 9*a* on the vehicle rear direction via a spherical flange. The other end of the turn suppression damper 12 on the vehicle rear direction is attached to the receiving section 6*a*, which is provided in the vehicle body 6, via a spherical flange.

Stopper members 14 are provided on the vehicle front direction and the vehicle rear direction of the bogie 7. The stopper members 14 are arranged along the axes 12*a* of the turn suppression dampers 12 and attached to the bogie frame cross beams 9*a*. Stopper rubbers 14*a* are respectively provided in both directions sections of the stopper members 14 in the vehicle lateral direction. On the other hand, stopper receiving sections 6*b* are provided in the vehicle body 6 along the axes of the turn suppression dampers 12. The stopper members 14 are arranged between the receiving sections 6*a* and the stopper receiving sections 6*b* of the vehicle body 6. The stopper members 14 are arranged a distance F apart from the receiving sections 6*a* and the stopper receiving sections 6*b* of the vehicle body 6 in the vehicle lateral direction. Therefore, the turn of the vehicle body 6 is regulated by contact of the stopper members 14 on the bogie 7 side and the receiving sections 6*a* or the stopper receiving sections 6*b* on the vehicle body 6 side.

A pair of flexible traction rods 15 are provided in the bogie 7. The flexible traction rods 15 are arranged along axes 15*a* extending in the vehicle longitudinal direction and configured to be capable of extending and retracting in the vehicle longitudinal direction. The axes 15*a* of the flexible traction rods 15 are a distance D apart from the middle point 13 of the bogie frame 9 in the vehicle lateral direction. Therefore, the pair of flexible traction rods 15 are arranged to be spaced apart from each other in the vehicle lateral direction to be symmetrical in the vehicle lateral direction. Ends 15*b* on the vehicle front direction of the flexible traction rods 15 are attached to receiving sections 6*c*, which are provided in the vehicle body 6 (shown in FIG. 1), via spherical flanges. Ends 15*c* on the vehicle rear direction of the flexible traction rods 15 are attached to the bogie frame cross beam 9*a* on the vehicle rear direction via spherical flanges.

With such a configuration, the bogie 7 is capable of turning $\theta=\tan^{-1}(F/E)$ at the maximum with respect to the vehicle body 6 about the middle point 13 of the bogie frame 9.

Figure 4:
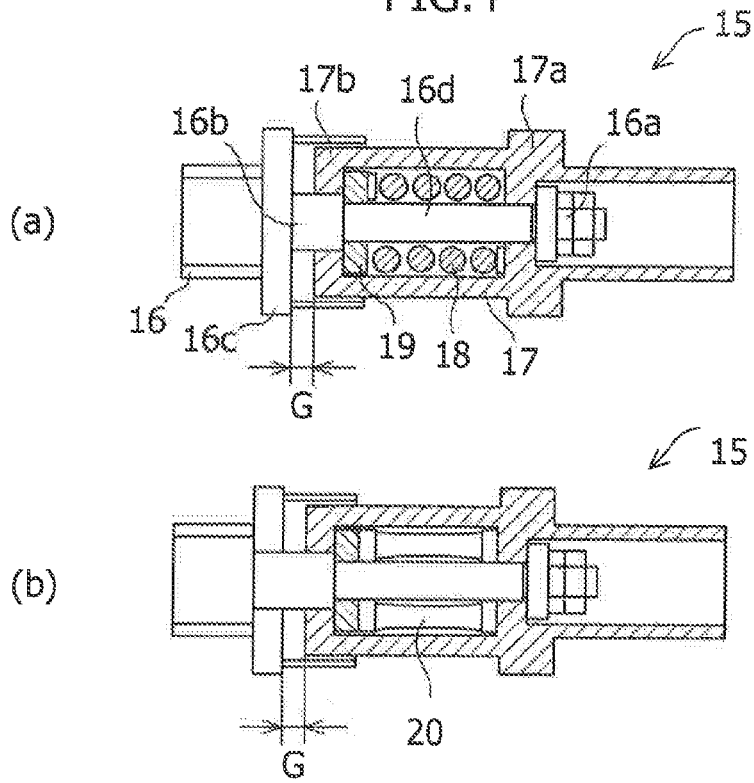
FIG. 4(*a*) is a longitudinal sectional view showing a schematic structure of a spring-type flexible traction rod in the vehicle in the first embodiment of the present invention.

An example of the structure of the flexible traction rod 15 is explaining with reference to FIG. 4(*a*). In FIG. 4(*a*), the flexible traction rod 15 is in a free supported state. The flexible traction rod 15 includes a piston rod 16 extending along a longitudinal direction of the flexible traction rod 15 and a cylindrical cylinder 17 extending along the longitudinal direction. A head section 16*a* is provided at the distal end of the piston rod 16. A cap section 16*b* is provided at the proximal end of the piston rod 16. A stopper section 16*c* is provided in the cap section 16*b*. A rod section 16*d* is provided between the head section 16*a* and the cap section 16*b*.

Both ends 17*a* and 17*b* in a longitudinal direction of the cylinder 17 are formed to close. Through holes are bored at both ends to pierce the piston rod 16 through the cylinder 17 and make it possible to move the cap section 16*b* and the rod section 16*d* of the piston rod 16 in the longitudinal direction in the cylinder 17. The head section 16*a* of the piston rod 16 and the end 17*a* of the cylinder 17 located on the head section 16*a* direction are in contact with each other and regulate the piston rod 16 from moving in the longitudinal direction toward the cap section 16*b* direction. On the other hand, the stopper section 16*c* of the piston rod 16 and the end 17*b* of the cylinder 17 located on the cap section 16*b* direction are arranged to be spaced a distance G apart from each other in the longitudinal direction. The piston rod 16 is movable by the distance G at the maximum in the longitudinal direction toward the head section 16*a* direction.

Furthermore, a coil spring 18 is disposed in the cylinder 17 along the longitudinal direction. A guide washer 19 is disposed between this coil spring 18 and the end 17*b* of the cylinder 17 located on the cap 16*b* direction. This guide washer 19 is in contact with the cap section 16*b* of the piston rod 16. When the cap section 16*b* moves in the longitudinal direction toward the head section 16*a* direction, the guide washer 19 moves together with the cap section 16*b* and the coil spring 18 is compressed.

Concerning the structure of the flexible traction rod 15, as another example, a rubber member 20 may be provided instead of the coil spring 18 as shown in FIG. 4(*b*).

Figure 2:
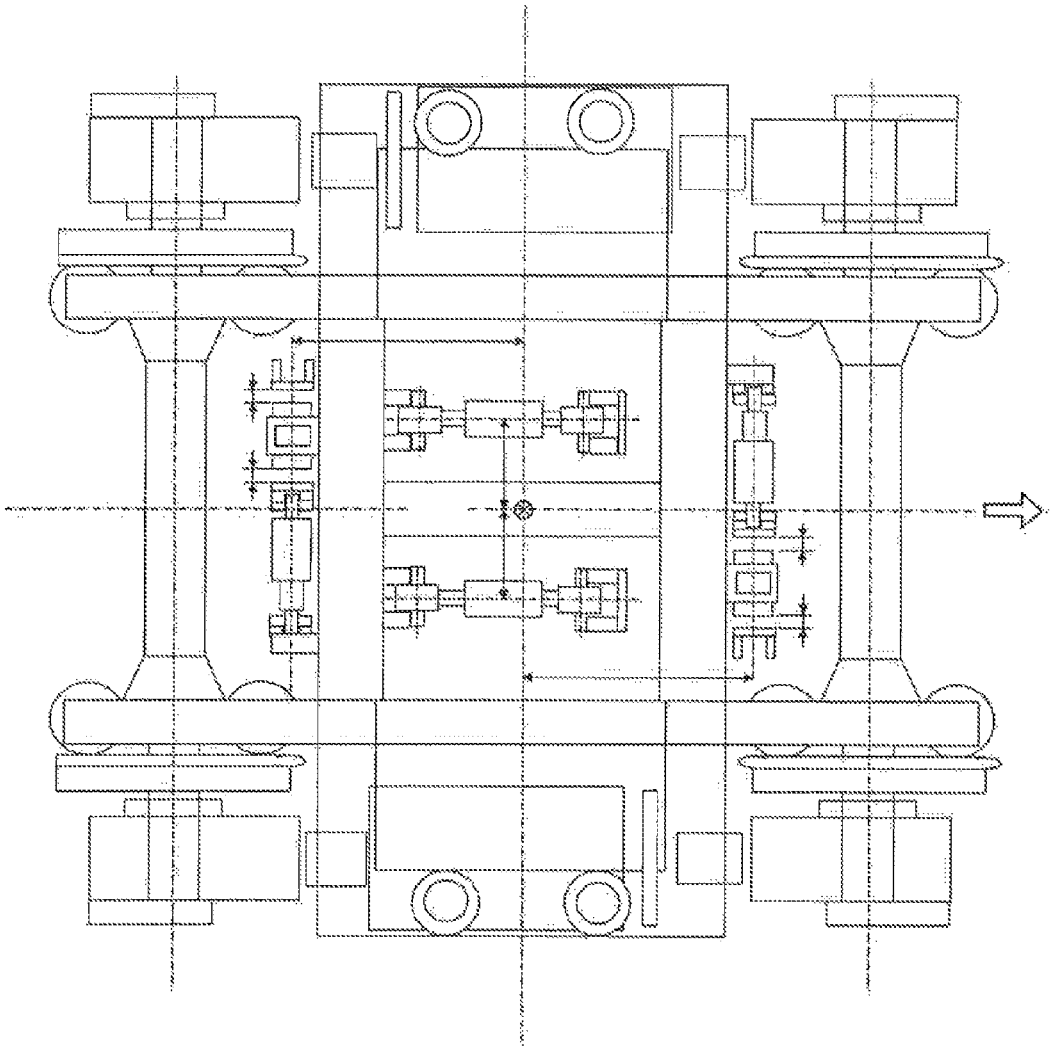
FIG. 2 is a plan view showing a bogie of the vehicle in the first embodiment of the present invention.
Figure 3:
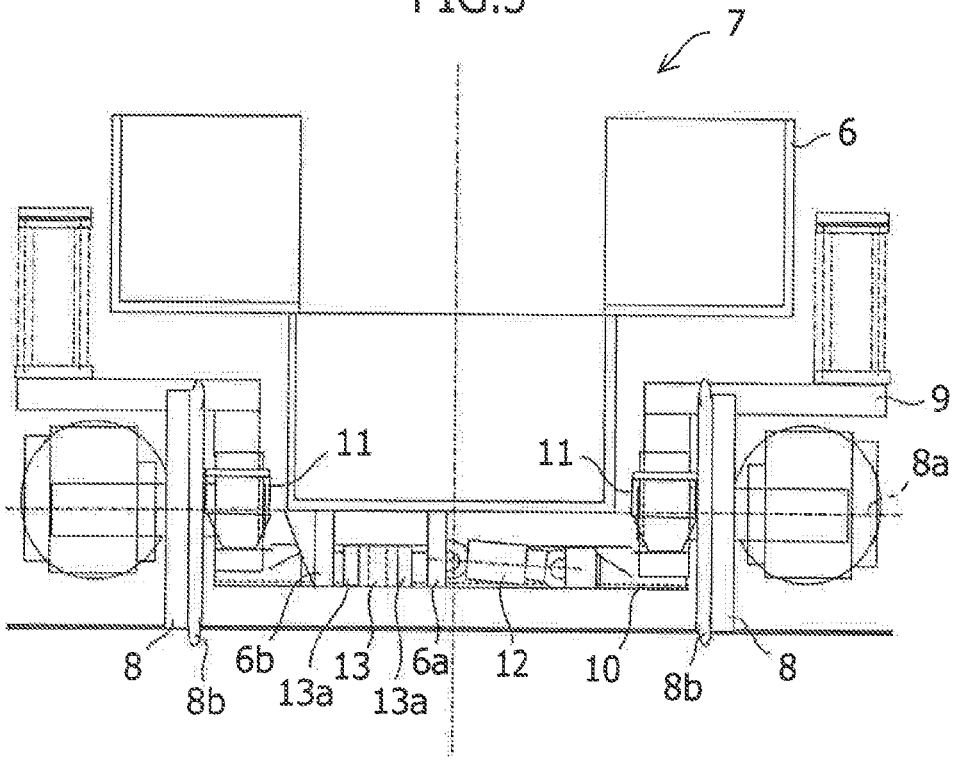
FIG. 3 is a front view showing the bogie of the vehicle in the first embodiment of the present invention.

Concerning the flexible traction rod 15 configured in this way, in FIG. 2, the cap section 16*b* of the piston rod 16 is arranged in a state in which the cap section 16*b* moves to the head section 16*a* direction. Such a state is a neutral state of the flexible traction rod 15. Since the coil spring 18 is in the compressed state, a pre-load P is applied to the flexible traction rod 15. For example, this pre-load P may be a magnitude set from a load applied to the flexible traction rod 15 when maximum acceleration is applied to the vehicle when fully loaded and a margin of the load. It is possible to prevent the bogie 7 from turning with respect to the vehicle body 6 because of the influence of vehicle weight or the like other than during curved track traveling. In other words, it is possible to secure traveling stability of the vehicle during linear track traveling. The structure of the flexible traction rod 15 shown in FIGS. 4(*a*) and 4(*b*) is only an example. The structure may be other structures as long as the flexible traction rod 15 is capable of extending and retracting.

Figure 5:
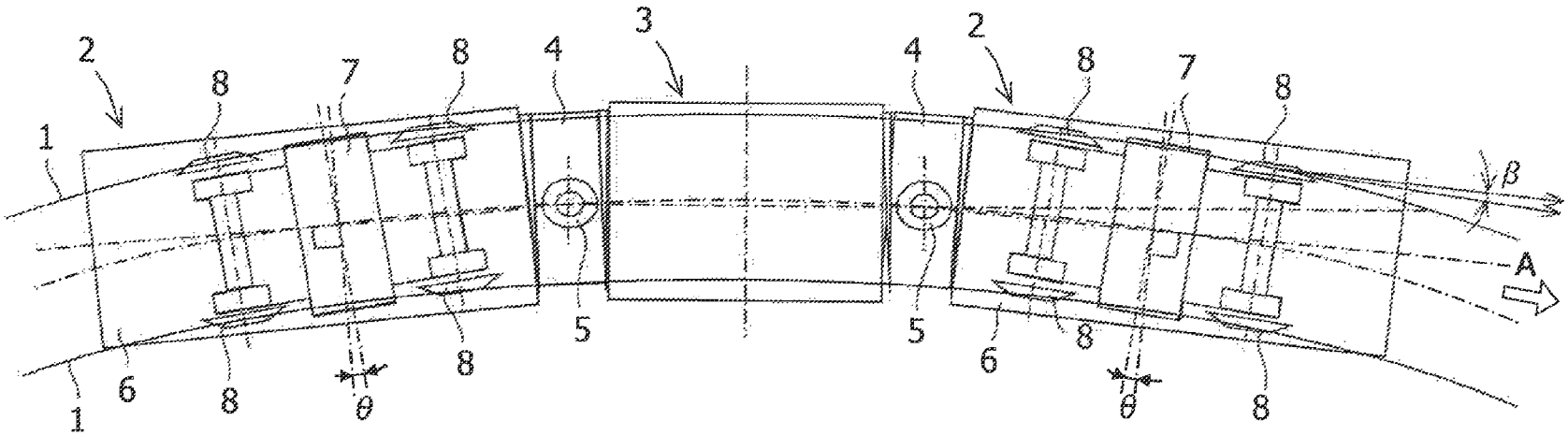
FIG. 5 is an explanatory diagram showing the low floor vehicle during curved track traveling in the first embodiment of the present invention.

Concerning such a vehicle in the first embodiment, an operation in traveling a curved track is explained with reference to FIGS. 2, 3, and 5. FIG. 5 is a diagram of the vehicle viewed from above. A traveling direction of the vehicle is indicated by the arrow A.

When the front vehicle 2 on the vehicle front direction enters the curved track, the wheel 8 on the outside rail side of the pair of wheels 8 comes into contact with the track 1 and force directed to the inner side in the vehicle lateral direction is applied to the wheel 8 on the outside rail side. Then, force for turning with respect to the vehicle body 6 acts on the bogie 7. At this point, one of the pair of flexible traction rods 15 extends and the other of the pair of flexible traction rods 15 retracts. Therefore, the bogie 7 turns by an angle θ at the maximum around the middle point 13 of the bogie frame 9 with respect to the vehicle body 6. Such an operation is also performed in the front vehicle 2 on the vehicle rear direction.

As explained above, with the vehicle in the first embodiment of the present invention, force directed in the straight forward direction by the inertia of the vehicle body 6 is absorbed by the turn of the bogie 7 and less easily affects the bogie 7. The bogie 7 easily curves along the curved track. As a result, the wheel 8 changes to a state more closely along the curved track and the vehicle can enter the curved track at a small attack angle. Therefore, when the vehicle enters the curved track, contact pressure between the wheel 8 on the outside rail side and the track 1 is relaxed, lateral pressure applied to the vehicle is reduced, and occurrence of vibration and creaking sounds of the vehicle are prevented. Therefore, riding comfort of passengers is improved and wear of the wheel flange 8*b* is reduced. In other words, the vehicle can smoothly pass the curved track.

With the vehicle in the first embodiment of the present invention, when external force from the vehicle lateral direction is applied to the vehicle other than the force acting on the bogie 7 from the track 1 when the vehicle enters the curved track, such external force is attenuated by the turn suppression dampers 12 provided on the vehicle front direction and the vehicle rear direction. Therefore, it is possible to prevent the bogie 7 from being turned with respect to the vehicle body 6 by force other than the force acting on the bogie 7 from the track 1. Therefore, the bogie 7 turns with respect to the vehicle body 6 only when the vehicle enters the curved track. On the other hand, during linear track traveling of the vehicle or the like, the bogie 7 does not turn with respect to the vehicle body 6 and traveling stability of the vehicle is secured. Since a movement amount in the vehicle lateral direction of the bogie 7 is limited by the stopper members 14, a large turn of the bogie 7 is prevented and traveling stability of the vehicle is further secured.

Second Embodiment

A vehicle in a second embodiment of the present invention is explained below. In the second embodiment, as in the first embodiment, the vehicle is explained using an LRV as an example of the vehicle. A basic configuration of the vehicle in the second embodiment is the same as the configuration of the vehicle in the first embodiment. Components that are the same as those in the first embodiment are explained using the same reference numerals and signs and names as those in the first embodiment. Components different from those in the first embodiment are explained. In the explanation of the second embodiment, it is assumed that a traveling direction of the vehicle is to the vehicle front.

Figure 6:
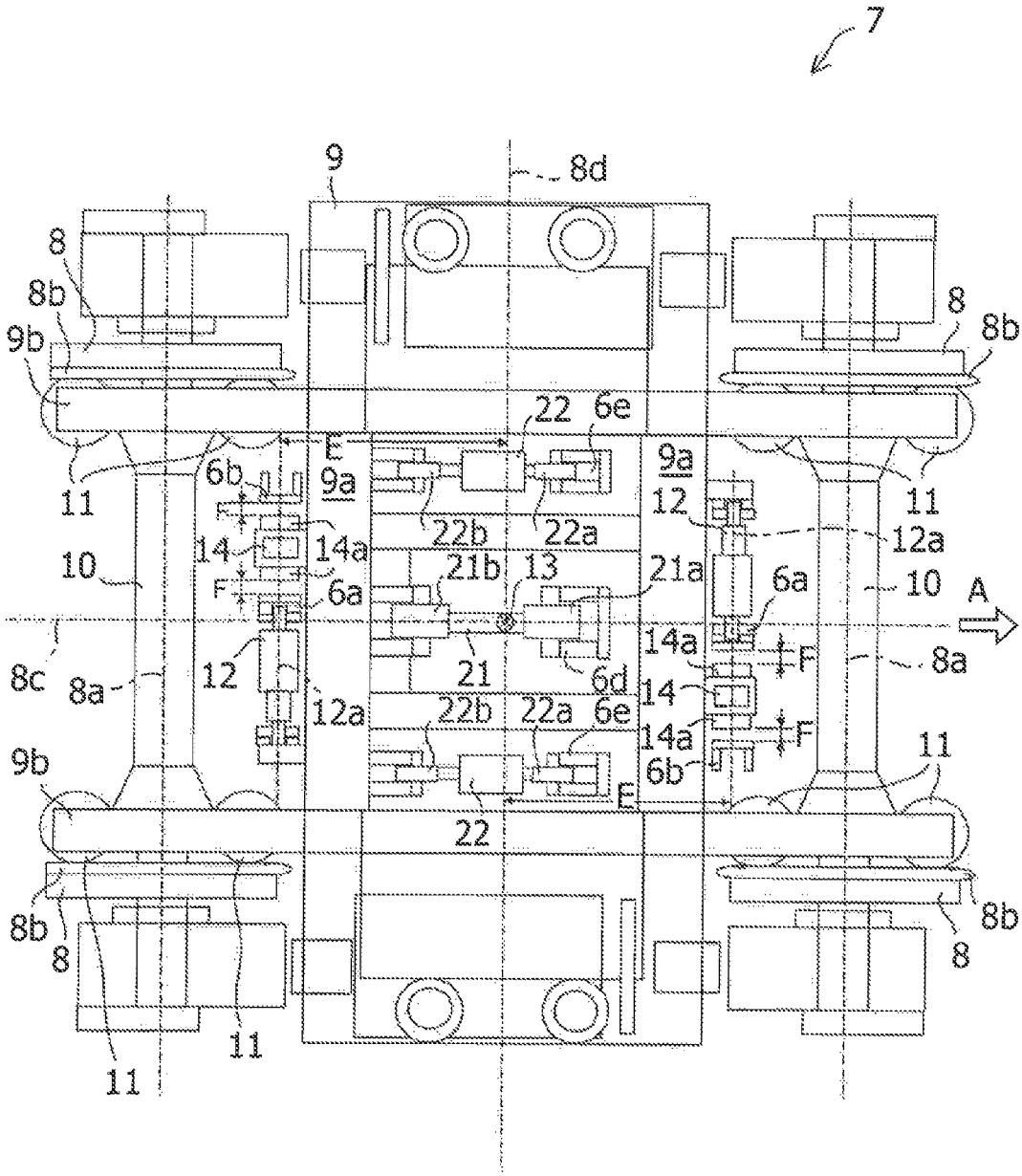
FIG. 6 is a plan view showing a bogie of a vehicle in a second embodiment of the present invention.
Figure 7:
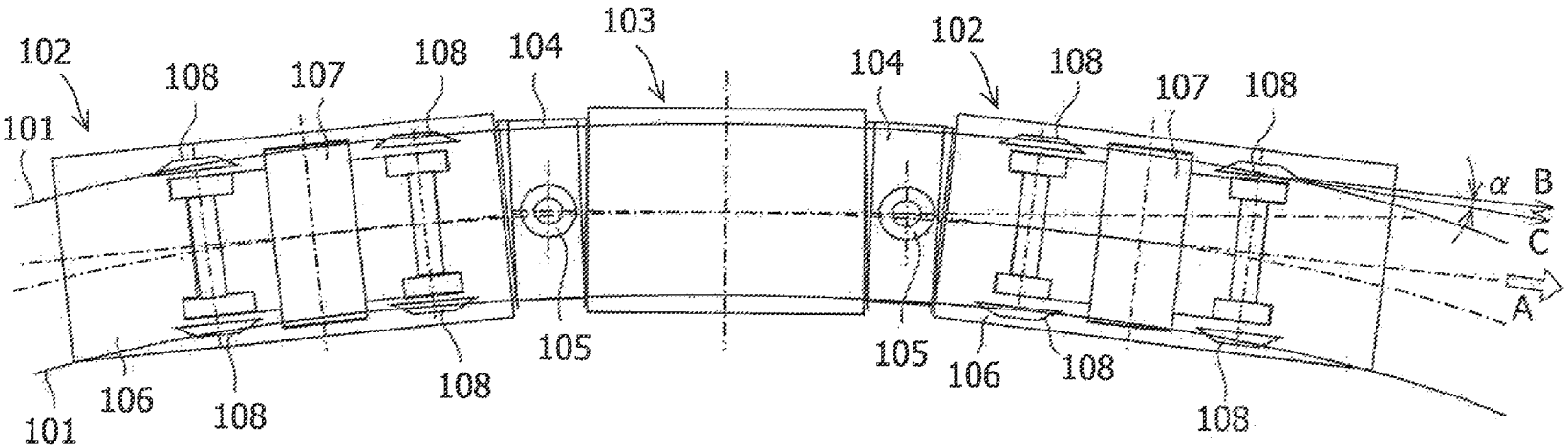
FIG. 7 is an explanatory diagram showing a conventional low floor vehicle during curved track traveling.
Figure 8:
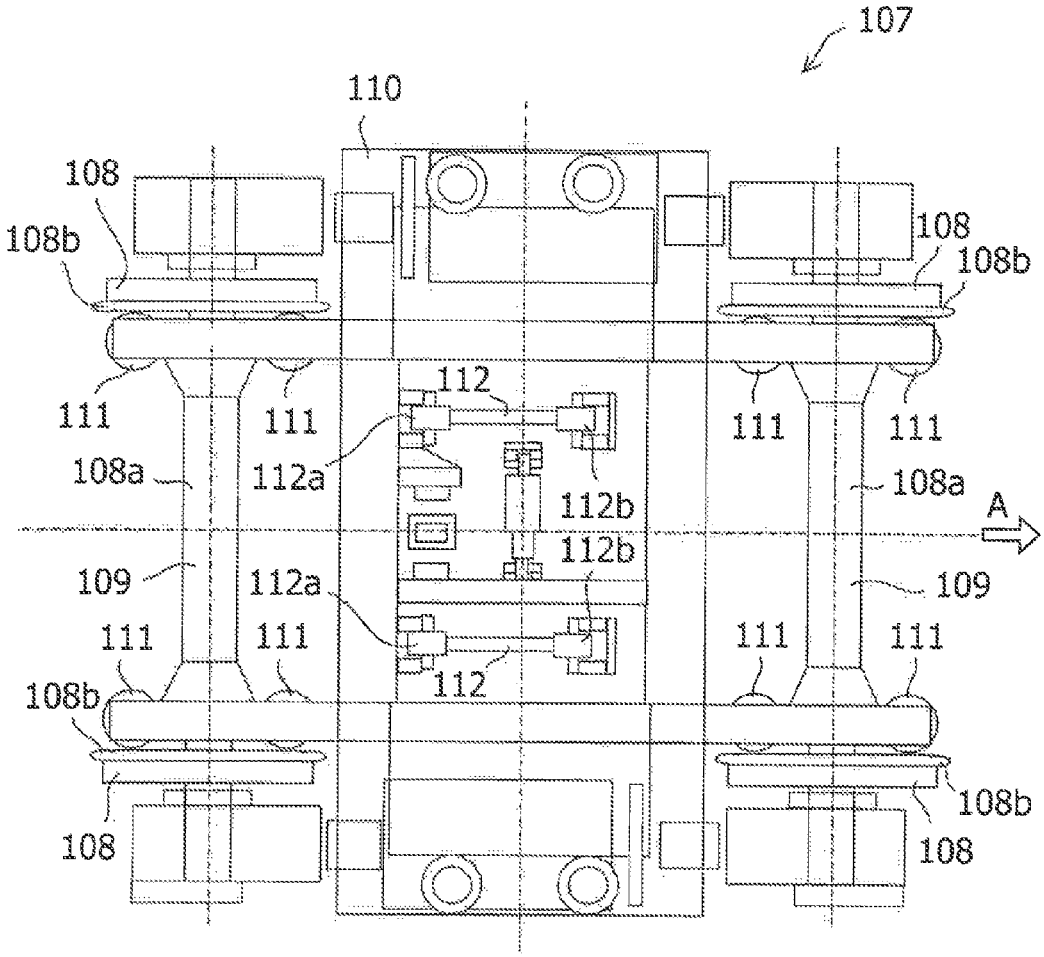
FIG. 8 is a plan view showing a bogie of the conventional vehicle.
Figure 9:
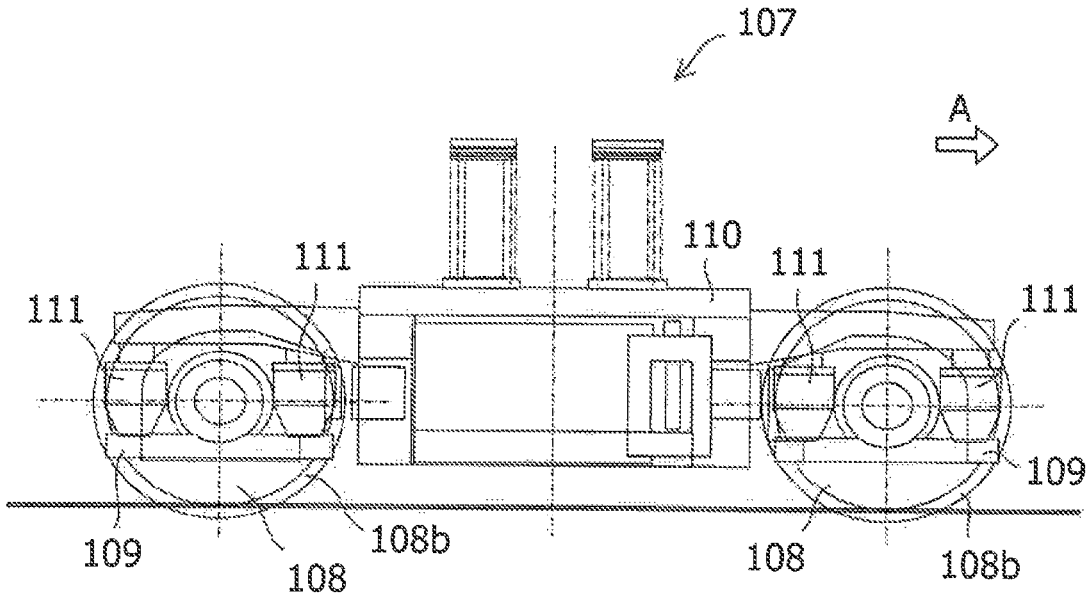
FIG. 9 is a side view showing the bogie of the conventional vehicle.
Figure 10:
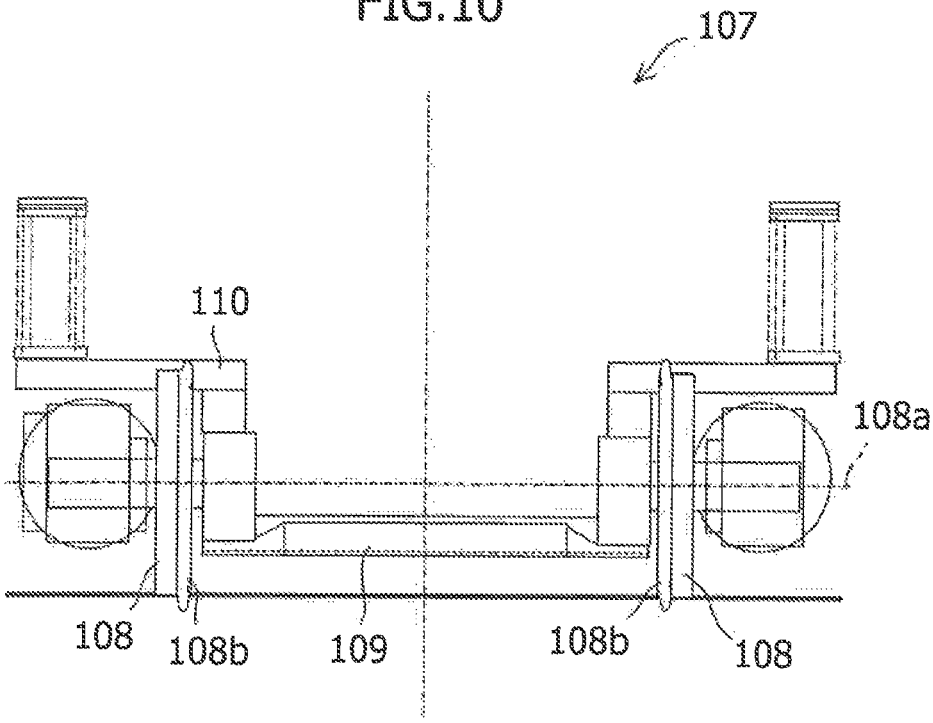
FIG. 10 is a front view showing the bogie of the conventional vehicle.

The structure of the bogie 7 in the second embodiment is explained with reference to the bogie 7 in a linear traveling time state shown in FIG. 6. One traction rod 21 is provided in the bogie 7. The traction rod 21 is arranged along the axis 8*c* passing the center between the wheels 8 on the vehicle front direction and the vehicle rear direction in a linear track traveling state and extending along the vehicle lateral direction. An end 21*a* on the vehicle rear direction of the traction rod 21 is attached to a receiving section 6*d*, which is provided in the vehicle body 6 (shown in FIG. 1), via a spherical flange. An end 21*b* at the vehicle front direction of the traction rod 21 is attached to the bogie frame cross beams 9*a* on the vehicle rear direction via a spherical flange.

A pair of restoring rods 22 configured the same as the flexible traction rods 15 in the first embodiment are provided in the bogie 7. As an example, the restoring rods 22 are respectively arranged on both left and right sides in the vehicle lateral direction of the traction rod 21. As another example, the restoring rod 22 may be provided only at one of the left and right sides in the vehicle lateral direction of the traction rod 21. An end 22*a* on the vehicle rear direction of the restoring rod 22 is attached to a receiving section 6*e*, which is provided in the vehicle body 6 (shown in FIG. 1), via a spherical flange. An end 22*b* on the vehicle front direction of the restoring rod 22 is attached to the bogie frame cross beam 9*a* on the vehicle direction via a spherical flange.

Concerning such a vehicle in the second embodiment, an operation in traveling on a curved track is explained with reference to FIGS. 4 and 6.

When the front vehicle 2 on the vehicle front direction enters the curved track, the wheel 8 on the outside rail side of the pair of wheels 8 comes into contact with the track 1 and force directed to the inner side in the vehicle lateral direction is applied to the wheel 8 on the outside rail side. Then, force for turning with respect to the vehicle body 6 acts on the bogie 7. At this point, one of the pair of restoring rods 22 extends and the other of the pair of restoring rods 22 retracts while referring to the traction rod 21 as a support reference. Therefore, the bogie 7 turns by an angle θ at the maximum about the middle point 13 of the bogie frame 9 with respect to the vehicle body 6. Such an operation is also performed in the front vehicle 2 on the vehicle rear direction.

As explained above, with the vehicle in the second embodiment of the present invention, force directed in the straight forward direction by the inertia of the vehicle body 6 is absorbed by the turn of the bogie 7 and less easily affects the bogie 7. The bogie easily curves along the curved track. As a result, the wheel 8 changes to a state more closely along the curved track and the vehicle can enter the curved track at a small attack angle. Therefore, when the vehicle enters the curved track, contact pressure between the wheel 8 on the outside rail side and the track 1 is relaxed, lateral pressure applied to the vehicle is reduced, and occurrence of vibration and creaking sound of the vehicle is prevented. Therefore, riding comfort of passengers is improved and wear of the wheel flange 8*b* is reduced.

With the vehicle in the second embodiment of the present invention, when external force from the vehicle lateral direction is applied to the vehicle other than the force acting on the bogie 7 from the track 1 when the vehicle enters the curved track, such external force is attenuated by the turn suppression dampers 12 provided on the vehicle front direction and the vehicle rear direction. Therefore, it is possible to prevent the bogie 7 from being turned with respect to the vehicle body 6 by force other than the force acting on the bogie 7 from the track 1. Therefore, the bogie 7 turns with respect to the vehicle body 6 only when the vehicle enters the curved track. On the other hand, during linear track traveling of the vehicle or the like, the bogie 7 does not turn with respect to the vehicle body 6 and traveling stability of the vehicle is secured. Since a movement amount in the vehicle lateral direction of the bogie 7 is limited by the stopper members 14, a large turn of the bogie 7 is prevented and traveling stability of the vehicle is further secured.

The embodiments of the present invention have been explained. However, the present invention is not limited to the embodiments explained above. Various modifications and alterations are possible on the basis of the technical idea of the present invention.

For example, as a first modification of the embodiments of the present invention, concerning composition of the vehicle, the number of front vehicles 2 and the number of intermediate vehicles 3 may be different from those in the embodiments as long as the bogies 7 are provided in the front vehicles 2 and the one intermediate vehicle 3 is arranged between the two front vehicles 2. Effects that are the same as the effects explained in the embodiments can be obtained.

As a second modification of the embodiments of the present invention, a rubber vibration insulator may be provided instead of the guide washer 19 of the flexible traction rods 15 or the restoring rods 22. Furthermore, it is possible to absorb a swing of the bogies 7 and effectively prevent occurrence of deflection of the journal members 10 and the wheels 8 involved in the swing.

REFERENCE SIGN LIST

1 track
2 front vehicles
3 intermediate vehicle
4 connecting sections
5 pin connectors
6 vehicle bodies
6*a*, 6*c*, 6*d*, 6*e* receiving sections
6*b* stopper receiving sections
7 bogies
8 wheels
8*a*, 8*c*, 8*d* axes
8*b* wheel flanges
9 bogie frame
9*a* bogie frame cross beams
9*b* bogie frame side beams
10 journal members
11 conical rubbers
12 turn suppression dampers
12*a* axes
12*b*, 12*c* ends
13 middle point
14 stopper members
14*a* stopper rubbers
15 flexible traction rods
15*a* axes
15*b*, 15*c* ends
16 piston rod
16*a* head section
16*b* cap section
16*c* stopper section
16*d* rod section
17 cylinder
17*a*, 17*b* ends
18 coil spring
19 guide washer
20 rubber member
21 traction rod
21*a*, 21*b* ends
22 restoring rods
22*a*, 22*b* ends
A, B, C arrows
D, E, F, G distances
O center
$\alpha$, $\beta$, $\theta$ angles

The invention claimed is:

1. A low floor vehicle comprising:

a bogie provided under a vehicle body and rotatable with respect to the vehicle body;

a bogie frame configured as a frame member of the bogie;

front and rear bogie frame cross beams arranged along a vehicle lateral direction in a middle in a vehicle longitudinal direction of the bogie frame and spaced apart from each other in the vehicle longitudinal direction; and a pair of front wheels and a pair of rear wheels provided forward and rearward with respect to the bogie frame cross beams, respectively, and configured to travel on a track, wherein a pair of flexible traction rods, arranged along the vehicle longitudinal direction and extendible and retractable in the vehicle longitudinal direction, are provided in the bogie, the flexible traction rods are spaced apart from each other in the vehicle lateral direction, one end of each of the flexible traction rods is attached to one of the bogie frame cross beams, and the other end of each of the flexible traction rods is attached to a first receiving section provided in the vehicle body, front and rear turn suppression dampers, arranged along the vehicle lateral direction for attenuating forces in the vehicle lateral direction, are provided in a front section of the front bogie frame cross beam and in a rear section of the rear bogie frame cross beam, respectively, a first end of each of the turn suppression dampers is attached to the corresponding bogie frame cross beam, and a second end of each of the turn suppression dampers is attached to a second receiving section provided in the vehicle body, a stopper receiving section provided in the vehicle body is spaced apart from the second receiving section in the vehicle lateral direction, and a stopper member provided in the bogie is arranged between the second receiving section and the stopper receiving section, and the stopper member is contactable with the second receiving section and the stopper receiving section so as to regulate a turn of the vehicle body.

2. A low floor vehicle comprising:

a bogie provided under a vehicle body and rotatable with respect to the vehicle body;

a bogie frame configured as a frame member of the bogie;

front and rear bogie frame cross beams arranged along a vehicle lateral direction in a middle in a vehicle longitudinal direction of the bogie frame and spaced apart from each other in the vehicle longitudinal direction; and a pair of front wheels and a pair of rear wheels provided forward and rearward with respect to the bogie frame cross beams, respectively, and configured to travel on a track, wherein a traction rod arranged along the vehicle longitudinal direction in a center in the vehicle lateral direction is provided in the bogie, one end of the traction rod is attached to one of the bogie frame cross beams, and the other end of the traction rod is attached to a first receiving section provided in the vehicle body, a restoring rod arranged along the vehicle longitudinal direction and extendible and retractable in the vehicle longitudinal direction is provided at least one of left and right outer sides in the vehicle lateral direction of the traction rod, one end of the restoring rod is attached to one of the bogie frame cross beams, and the other end of the restoring rod is attached to the receiving section provided in the vehicle body, front and rear turn suppression dampers, arranged along the vehicle lateral direction for attenuating forces in the vehicle lateral direction, are provided in a front section of the front bogie frame cross beam and in a rear section of the rear bogie frame cross beam, respectively, a first end of each of the turn suppression dampers is attached to the corresponding bogie frame cross beam, and a second end of each of the turn suppression dampers is attached to a second receiving section provided in the vehicle body, a stopper receiving section provided in the vehicle body is spaced apart from the second receiving section in the vehicle lateral direction, and a stopper member provided in the bogie is arranged between the second receiving section and the stopper receiving section, and the stopper member is contactable with the second receiving section and the stopper receiving section so as to regulate a turn of the vehicle body.

* * * * *